US005404667A

United States Patent [19]

Schmitter

[11] Patent Number: 5,404,667

[45] Date of Patent: Apr. 11, 1995

[54] FRONT SIGHT RETENTION MEANS FOR HANDGUNS

[75] Inventor: Edward P. Schmitter, Easthampton, Mass.

[73] Assignee: Smith & Wesson Corp., Springfield, Mass.

[21] Appl. No.: 204,669

[22] Filed: Mar. 2, 1994

[51] Int. Cl.[6] ..... F41G 1/00

[52] U.S. Cl. ..... 42/100; 42/101

[58] Field of Search ..... 42/100, 101; 33/233, 33/241, 250; D22/109, 110; 24/297, 453, 508, 625

[56] References Cited

U.S. PATENT DOCUMENTS

| | | | |
|---|---|---|---|
| 3,154,281 | 10/1964 | Frank | 248/201 |
| 3,577,608 | 5/1971 | Texler | 24/593 |
| 4,015,354 | 3/1976 | Brouthers | 42/100 |
| 5,016,381 | 5/1991 | Ferraro | 42/100 |
| 5,016,382 | 5/1991 | Pickle | 42/100 |
| 5,202,524 | 4/1993 | Nechushtan | 42/100 |
| 5,333,965 | 8/1994 | Mailey | 403/406.1 |

*Primary Examiner*—Charles T. Jordan
*Assistant Examiner*—Theresa M. Wesson
*Attorney, Agent, or Firm*—Chapin, Neal & Dempsey

[57] ABSTRACT

An improved means is provided for mounting a front sight onto the slide of a semi-automatic pistol. The sight includes an upper portion and an integral anchor portion of a resilient polymeric material in which the upper portion is adapted to disposed on the upper surface of the slide. An elongated opening is formed in the slide, is dimensioned to receive therein the anchor portion of the sight and has a predetermined depth terminating at an inner surface portion of the slide adjacent the lower edge of the opening. The anchor portion has a plurality of legs spaced apart in a peripheral array and which extend downward from the upper portion. Each lo leg has at its lower end a radially extending foot having a beveled lower surface adapted to engage the outer edge of the opening and to flex the legs inwardly for fitting into and through the opening. The legs are each of a length which is slightly greater than the predetermined depth of the opening so that when the anchor portion has been fitted into and pressed downwardly in the opening, upon the foot portions of the legs reaching said predetermined depth, the legs will flex outwardly so that the foot portions will engage the marginal edge at the inner edge of the opening to lock the sight onto the slide.

5 Claims, 2 Drawing Sheets

FRONT SIGHT RETENTION MEANS FOR HANDGUNS

FIELD OF THE INVENTION

This invention relates to gun sights for firearms and more particularly to improved means for mounting a front sight onto the slide of semi-automatic handguns.

BACKGROUND OF THE INVENTION

Semi-automatic handguns typically have a front sight which comprise a discrete member mechanically affixed to the upper surface of the slide adjacent the front end thereof. U.S. Pat. Nos. 875,016; 4,015,354; 5,016,381; and 5,016,382 disclose a number of varying mechanical means for mounting front sights onto barrels of handguns.

In the '354 Patent, the sight is fixed to the barrel by a set-screw threaded into a bore machined into the barrel. The drawback of this arrangement is that the vibration and shock which handguns experience during firing have a tendency to become loosened and with resulting sight misalignment which will have an adverse affect on the accuracy of the gun. Patents '381 and '382 disclose means for removably mounting a front sight using detents with coil springs disposed within a cavity provided in the barrel. These means of retaining a sight are expensive and require the fabrication of a number of parts and multiple assembly steps for mounting each sight.

As disclosed in U.S. Pat. No. 5,202,524, the sight may also be mounted on the slide by fitting the same into a slot disposed thereon and then swaging the base of the sight to thereby permanently secure the same thereto. This method of retaining the sight requires special tools and fixtures to hold it in place for the swaging operations. Another serious drawback would be encountered in the event the sight should be damaged and needs to be replaced. In that case, extensive machining would be required for removal of the old sight in addition to a further swaging operation to reinstall the replacement thereof.

Accordingly, it is the primary object of the present invention to provide a gun sight that overcomes the drawback of the prior art.

It is another object to simplify the manufacture and assembly of the sight.

It is a further object to a provide gun sight that may be easily replaced.

SUMMARY OF THE INVENTION

According to the present invention, an improved means for mounting a front sight onto the slide of a handgun includes a sight portion disposed on the upper surface of the slide. A plurality of legs are disposed in a peripheral arrangement and depend from the underside of the sight portion. Each of the legs terminates in a radially extending foot portion that extends a substantial distance radially outward of the leg and has a beveled lower edge adapted to engage the upper edges of an opening provided through the slide of the gun. The legs are of a polymeric material and are sufficiently resilient to flex inwardly to enable said legs, including the foot portions, to fit into and through the opening and then to spring outwardly to an tin flexed condition, enabling the foot portions to engage the underside of the opening to thereby anchor the sight in fixed relation onto the slide of the gun.

The above and other objects and advantages of this invention will become more readily apparent when the following description is read in conjunction with the accompanying drawings.

DETAILED DESCRIPTION OF THE PREFERRED EMBODIMENTS

Figure 1:
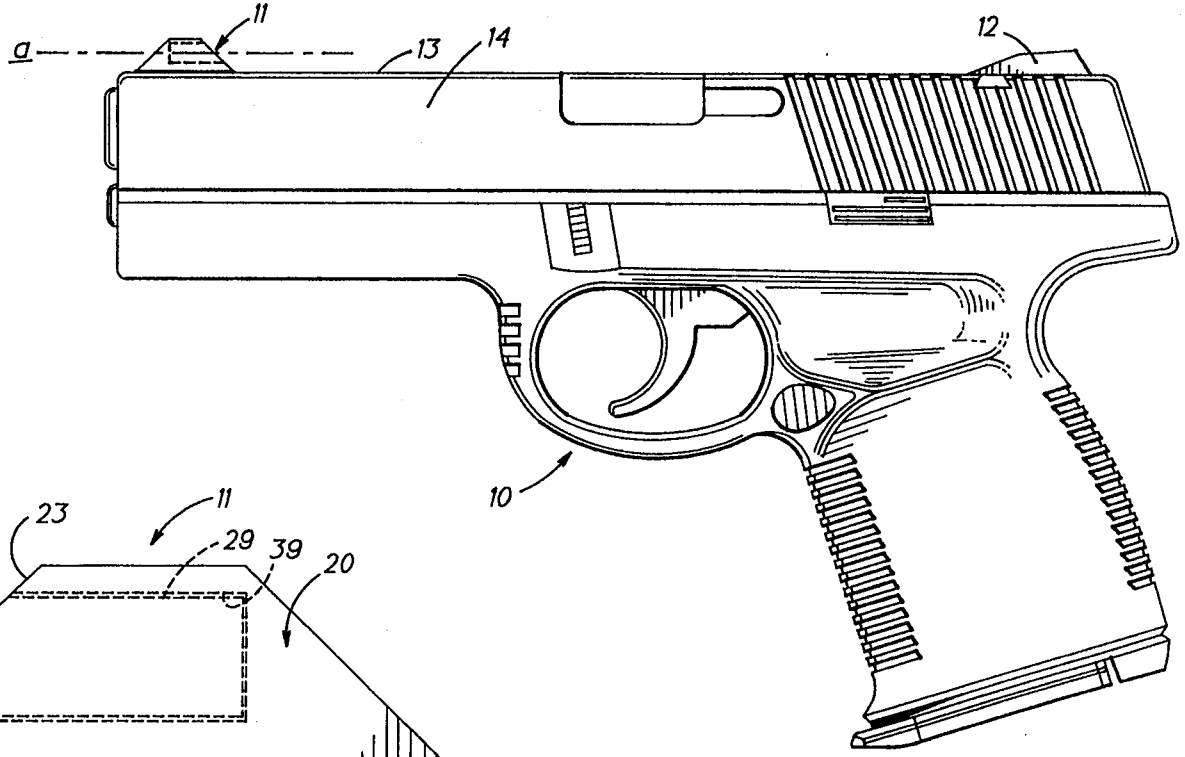
FIG. 1 is an elevational view of a semi-automatic handgun which incorporates the present invention.
Figure 3:
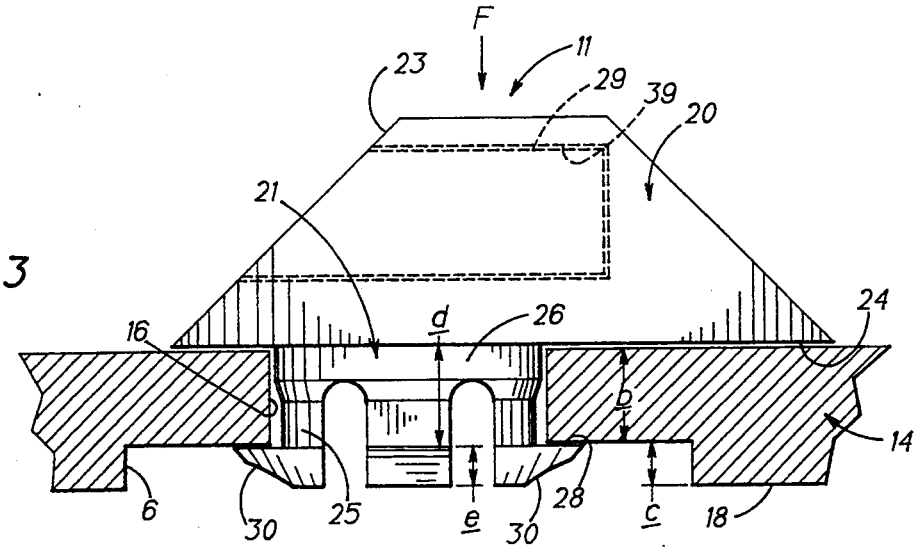
FIG. 3 is a side elevational view of the sight of the present invention fitted onto the slide of the gun.
Figure 5:
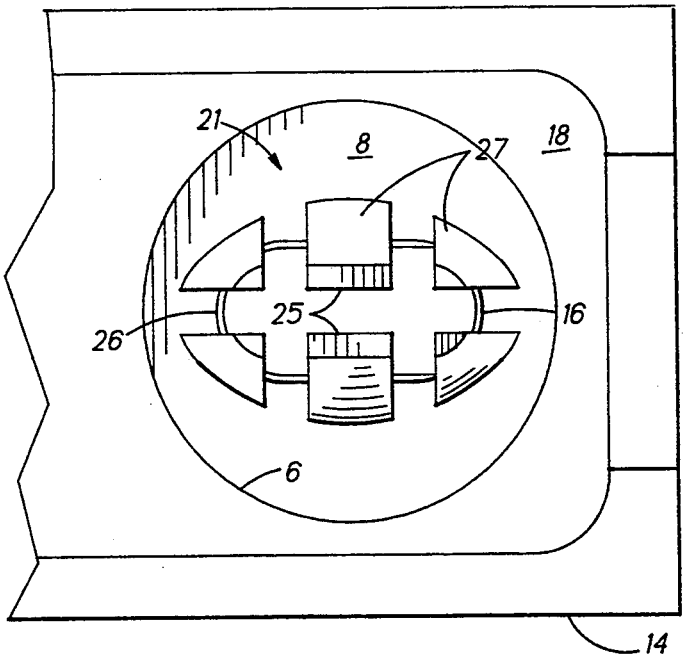
FIG. 5 is a bottom elevational view of the present invention of FIG. 3.

Referring to FIG. 1, a semi-automatic handgun 10 is shown having a front sight 11 and a rear sight 12 mounted upon a top surface 13 of a slide 14. An opening 16, as shown in FIG. 5, is provided into the slide 14 frown its upper surface 13 to a predetermined depth b (FIG. 3). The opening 16 is of elongated configuration with its longer dimension aligned with the line-of-sight a (FIG. 1) defined by the front and rear gun sights. The elongated configuration is utilized to ensure that the sight will remain in alignment with the sighting axis of the gun. An enlarged circular recess or counterbore 6 is formed from the inner surface 18 of the slide 14 to provide an undercut marginal edge portion 8 about the periphery of the opening 16. The recess 6 has an axial length or depth c (FIG. 3) to accommodate the lower extremities of the anchor portion of the sight when mounted on the slide 14 of the gun, as will be discussed hereinafter. It is essential that the depth of the recess 6 be sufficient so that the lower extremities or foot portions of the sight will not interfere with movement of the slide and the barrel during firing and recoil of the gun.

Figure 2:
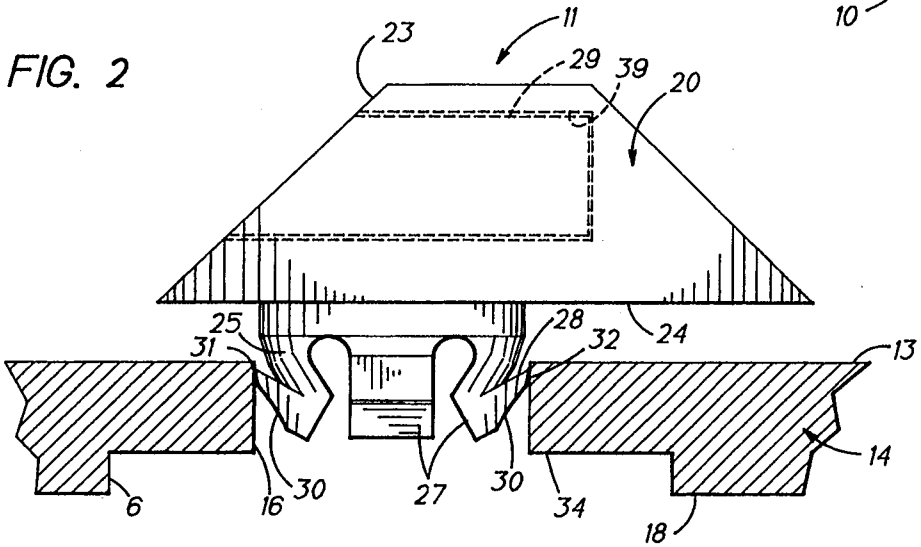
FIG. 2 is a partial side elevational view, on a greatly enlarged scale, showing the sight of FIG. 1 being affixed onto a side of a handgun.
Figure 4:
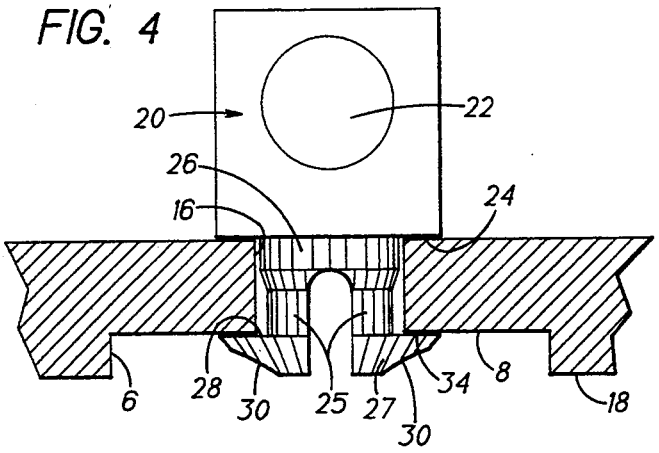
FIG. 4 is an end elevational view of the sight fitted onto the gun.

The front sight 11, as best shown in FIGS. 2–4 comprises an upper sight portion 20 having a generally planar lower surface 24 adapted to abut the upper surface 13 of the slide 14 about the opening 16 and a lower anchor or fastener portion 21 adapted to fit securely into the opening 16 and recess 6 for mounting of the sight on the slide 14 of the gun, as will be hereinafter described in greater detail. Preferably the sight is fabricated of a polymeric material such as Nylon 6/6 available from Dupont with an elastomer content to impart a sufficient degree of resilience so that the leg portions of the sight will be capable flexing inwardly and then spring back to interlock the sight on the gun as described herein.

In the embodiment shown, the upper portion 20 of the sight is generally of a trapezoidal shape having a sighting spot or dot 22 disposed on rearwardly-facing, inclined surface 23. When viewed from the vantage point of the shooter and in the direction of line-of-sight a in FIG. 1, the sighting spot appears as a circular dot 22 preferably of contrasting color to the upper portion of the sight 11. As illustrated in FIG. 2, the spot may be in the form of a rod or insert 29 of a brightly colored, yellow, white or luminescent plastic disposed within a socket 39 provided in the upper portion 20 of the sight. It should be understood, however, that this invention is not limited to a sight of any particular configuration or markings but may be of any form or size.

In accordance with this invention and as best illustrated in FIGS. 3–5, the anchor portion 21 comprises a plurality of resiliently flexible legs 25 which depend from a ring portion 26 integral with the tinder surface 24 of the upper portion 20. The legs 25 are laterally spaced apart from one to the other with each pair of adjacent legs having generally parallel side edge portions fairing from an arcuate edge portion 33 therebetween. The legs 25 having their outer surfaces define a peripheral array o:f generally the same configuration and size as the elongated opening 16 provided in the slide, as best shown in FIGS. 2 and 5, so as to provide a slide clearance fit when the sight 11 is mounted on the slide 14. As best illustrated in FIG. 5, there are six legs with one of the legs disposed along each of two longer sides of the opening 16 and the four other legs are disposed at each of the corners where the longer sides of the opening 16 fare together with the end walls thereof. It is also within the scope of this invention that four legs could also be effectively used. From the undersurface 24 of the upper portion, each leg has a length d that terminates at the upper surface 28 of a foot portion 27 that is slightly greater than the depth b or axial dimension of the opening 16. Each foot portion 27 extends radially outward from the leg thereby defining an outer edge or toe portion 28 engageable with the marginal edge portion 34 of the slide adjacent to the opening 16 and within the recess 6. The height e of each foot 27 is less than the depth d of the recess 6 so that the foot portions of the anchor will not extend below the inner or lower surface 18 of the slide 14. The lower surface of each foot is obliquely angled or beveled upwardly toward the outer tip thereof as at 30 to facilitate the insertion of the anchor portion into the opening 16 in the slide, to be discussed hereinafter.

Referring to FIG. 2 and 3, the front sight 11 is mounted to the slide 14 by positioning the sight above the opening 16 whereby the sighting point 22 will be oriented toward the user of the handgun during firing. The anchor portion should also be disposed downward and in registered relation with opening 16. By applying a downward force F to the sight, the beveled surfaces 30 on the underside of each foot is pressed into engagement with the upper edge or corner 31 of the opening 16. As a result of this geometric relationship, an inward component of force will be exerted on each of the legs 25 to cam or flex the legs inwardly as shown in FIG. 2, until the outer edges 32 of the foot portions clear the upper corner 31 of the opening 16. The outer edges of the foot portions will then engage and slide along the inner wall of the opening 16 as the anchor portion is being moved downward to fit the sight into the opening 16. When the outer edges 32 of the foot portions 27 have been moved to a point below the inner or lower edge 34 of the opening, the legs will snap back to their original or unflexed orientation, as best shown in FIG. 3. As that occurs, the upper surface 28 of each foot will move under the edge 34 and engage the marginal portion of the surface 8 within the recess 6 surrounding and adjacent the opening 16. At the same time, the undersurface 24 of the upper portion 20 will engage the upper surface 13 of the slide 14 thereby securely anchoring or mounting the front sight 11 in place on the gun.

Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described my invention, what is claimed is:

1. Improved means for mounting a gun sight on a semi-automatic handgun including a slide provided with an opening that extends from an upper surface of said slide toward an inner surface thereof a predetermined distance from said upper surface and which terminates with a counterbore to said opening from said inner surface having a diameter sufficient to provide a marginal surface disposed about the peripheral edge of the opening located at said predetermined distance, said opening having an elongated configuration defined by longer side wall portions disposed generally in the direction of the line of sight of the gun, end walls transverse to the side walls and corner wall portions disposed between the side and end walls of said opening, the improvement comprising an upper portion of the sight adapted to engage the upper surface of the slide about said opening and an anchor portion extending from the underside of the upper portion of said sight and comprising a plurality of legs depending in a peripheral array therefrom, each of said legs including an upper shank portion and a radially and outwardly extending foot portion at the lower end thereof, the shank portions of said legs having outer surfaces which, in a plane parallel to the under surface of the sight and generally defining, in part, a configuration approximately the same but slightly smaller than that of said elongated opening and being adapted to engage the corner wall portions of the opening so that the sight will be prevented from rotating relative to the frame, each of said foot portions extending outwardly of the shank portions sufficiently to provide generally coplanar upper surfaces generally parallel to said under surface of the sight, each of said legs being of a length from said under surface to the upper surface of each foot portion that is slightly greater than said predetermined distance, said legs having sufficient resilience to be deflected inwardly for fitting through the opening and for snapping outwardly so that the upper surfaces of said foot portions will engage the marginal surface about said opening to thereby secure said sight onto said gun.

2. Improved means for mounting a sight on the slide of a semi-automatic handgun, as set forth in claim 1, wherein an annular portion extends downwardly of said upper portion of the sight and adjacent pairs of said legs depend therefrom and are separated by a generally concave arcuate surface therebetween.

3. Improved means for mounting a sight on the slide of a semi-automatic handgun, as set forth in claim 1, further comprising four corner legs and at least one leg engageable with the side wall of the opening.

4. Improved means for mounting a sight on the slide of a semi-automatic handgun, as set in claim 1, wherein said legs depend from said annular portion integral with said upper portion and comprising four corner legs and two side wall engaging legs.

5. Improved means for mounting a sight on the slide of a semi-automatic handgun, as set forth in claim 1, and wherein the sight is composed of a polymeric material which includes an elastomer that imparts resilience to said legs sufficient to enable them to be flexed inwardly during insertion thereof into the opening and to then snap back to engage the inner surface of the slide.

* * * * *